US009192792B2

(12) United States Patent
Moine et al.

(10) Patent No.: US 9,192,792 B2
(45) Date of Patent: Nov. 24, 2015

(54) FALL ARREST SAFETY APPARATUS WITH BLOCKING ON A ROPE

(71) Applicant: ZEDEL, Crolles (FR)

(72) Inventors: Julien Moine, La Terrasse (FR); Alain Maurice, Saint Hilaire du Touvet (FR); Michael Chaumontet, Crolles (FR)

(73) Assignee: ZEDEL, Crolles (FR)

( * ) Notice: Subject to any disclaimer, the term of this patent is extended or adjusted under 35 U.S.C. 154(b) by 138 days.

(21) Appl. No.: 14/154,426

(22) Filed: Jan. 14, 2014

(65) Prior Publication Data

US 2014/0196989 A1 Jul. 17, 2014

(30) Foreign Application Priority Data

Jan. 15, 2013 (FR) ..... 13 00075

(51) Int. Cl.
*B65H 59/16* (2006.01)
*A62B 1/14* (2006.01)
*A63B 29/02* (2006.01)

(52) U.S. Cl.
CPC .. *A62B 1/14* (2013.01); *A63B 29/02* (2013.01)

(58) Field of Classification Search
None
See application file for complete search history.

(56) References Cited

U.S. PATENT DOCUMENTS

| | | | | | |
|---|---|---|---|---|---|
| 3,638,713 | A | | 2/1972 | Knell et al. | |
| 4,034,828 | A | * | 7/1977 | Rose et al. | 182/5 |
| 4,546,851 | A | * | 10/1985 | Brennan | 182/7 |
| 4,560,029 | A | * | 12/1985 | Dalmaso | 182/5 |
| 4,657,110 | A | * | 4/1987 | Wolner | 182/5 |
| 4,923,037 | A | | 5/1990 | Stephenson et al. | |
| 5,156,240 | A | * | 10/1992 | Ostrobrod | 188/65.1 |
| 5,265,696 | A | * | 11/1993 | Casebolt | 182/8 |
| 5,638,919 | A | * | 6/1997 | Pejout | 182/192 |
| 5,664,640 | A | * | 9/1997 | Smith | 182/5 |
| 5,845,894 | A | * | 12/1998 | Petzl et al. | 254/391 |
| 5,855,251 | A | * | 1/1999 | Deuer | 182/5 |
| 6,056,086 | A | * | 5/2000 | Gortan et al. | 182/197 |
| 6,694,922 | B2 | | 2/2004 | Walter et al. | |

(Continued)

FOREIGN PATENT DOCUMENTS

| | | |
|---|---|---|
| EP | 1 380 320 A1 | 1/2004 |
| EP | 1 525 903 A1 | 4/2005 |

(Continued)

OTHER PUBLICATIONS

Mar. 3, 2015 Office Action issued in U.S. Appl. No. 14/154,921.
U.S. Appl. No. 14/154,921, filed Jan. 14, 2014 in the name of Moine et al.
Aug. 12, 2015 Office Action issued in U.S. Appl. No. 14/154,921.

*Primary Examiner* — Robert A Siconolfi
*Assistant Examiner* — James Hsiao
(74) *Attorney, Agent, or Firm* — Oliff PLC

(57) ABSTRACT

A fall arrest safety apparatus with blocking on a rope, comprising:

a rigid body provided with a trunking for housing the rope, a securing system designed to swivel between a closed position to collaborate with the rope by blocking the latter at the bottom of the trunking in case of a fall, and an open position releasing access to the trunking for fitting or removal of the rope, and a control device to move said securing system from the closed position to the open position, and vice-versa, wherein the control device comprises a pair of gripping cleats able to be actuated simultaneously to stabilize and lock the securing system in the open position, the two gripping cleats being arranged side by side on a transverse pivot-pin integral to the pivoting securing system.

10 Claims, 7 Drawing Sheets

(56) References Cited

U.S. PATENT DOCUMENTS

| | | | | |
|---|---|---|---|---|
| 6,793,046 | B2 | 9/2004 | Petzl et al. | |
| 7,036,459 | B1 | 5/2006 | Mugford et al. | |
| 7,137,481 | B2 | 11/2006 | Petzl et al. | |
| 8,225,905 | B2 * | 7/2012 | Delaittre et al. | 182/192 |
| 2004/0020727 | A1 * | 2/2004 | Petzl et al. | 188/65.1 |
| 2005/0082115 | A1 * | 4/2005 | Petzl et al. | 182/5 |
| 2007/0215411 | A1 | 9/2007 | Petzl et al. | |
| 2008/0230015 | A1 | 9/2008 | Bleshoy | |
| 2009/0026023 | A1 | 1/2009 | Petzl et al. | |
| 2012/0193166 | A1 | 8/2012 | Rogelja | |

FOREIGN PATENT DOCUMENTS

| | | | |
|---|---|---|---|
| EP | 1 380 320 | B1 | 5/2005 |
| EP | 2 527 009 | A2 | 11/2012 |
| ES | 2 005 895 | | 4/1989 |
| FR | 2 005 895 | | 12/1969 |
| GB | 1271275 | | 4/1972 |
| GB | 2 192 664 | A | 1/1988 |
| WO | WO 98/02210 | | 1/1998 |

* cited by examiner

FALL ARREST SAFETY APPARATUS WITH BLOCKING ON A ROPE

BACKGROUND OF THE INVENTION

The invention relates to a fall arrest safety apparatus with blocking on a rope, comprising:

- a rigid body provided with a trunking for housing the rope,
- a securing system designed to swivel between a closed position to collaborate with the rope by blocking the latter at the bottom of the trunking in case of a fall, and an open position releasing access to the trunking for fitting or removal of the rope,
- and a control device to move said securing system from the closed position to the open position, and vice-versa.

STATE OF THE ART

The document FR2600898 relates to an ascender on a rope in which the securing system is formed by a pivoting trigger designed to collaborate in the closed position with the rope. The latter can slide in the trunking of the body in the ascending direction, or on the contrary be blocked by the trigger in case of the user falling. The trigger is provided with a gripping lever able to be actuated to the open position releasing access to the trunking and enabling the rope to be inserted in the trunking. The lever is provided with a handle facilitating the opening and reclosing operation. In normal use of the ascender, certain handling operations of the rope can exert a certain pressure or friction of the rope on the lever liable to cause involuntary opening of the trigger, to the detriment of safety.

The document EP 2911870 mentions an ascender with a cam for belaying on a fixed rope, said ascender comprising a link arm with a key-hole articulated between the pivot-pin of the cam and the trunking body. A double lock which is securedly attached to the body is configured to keep the two opposite ends of the pivot-pin in aligned recesses acting as bearings. The presence of the double lock and of the link arm enables the pivot-pin to be inserted in and removed from the recesses quickly.

OBJECT OF THE INVENTION

The object of the invention consists in securing operation of a fall arrest apparatus and blocking on the rope preventing any involuntary opening of its securing system.

The safety apparatus according to the invention is characterized in that the control device comprises a pair of gripping cleats able to be actuated simultaneously to stabilize and lock the securing system in the open position allowing access to the trunking, the two gripping cleats being arranged side by side on a transverse pivot-pin integral to the pivoting securing system.

According to a preferred embodiment, a fixed blade made from plastic material is advantageously interposed between the two gripping cleats to prevent pressing of one of the cleats from causing movement of the other cleat.

According to one feature of the invention, each gripping cleat is equipped with a boss designed to come up against a stop of the body when the two cleats are not actuated simultaneously by pivoting in the opening direction.

Such a control device with a double cleat can be used in any safety apparatus on a rope, whether it be of fall arrest with roller or ascender with cam type.

BRIEF DESCRIPTION OF THE DRAWINGS

Other advantages and features will become more clearly apparent from the following description of two embodiments of the invention given for non-restrictive example purposes only and illustrated in the appended drawings, in which.

DESCRIPTION OF A PARTICULAR EMBODIMENT

Figure 1:
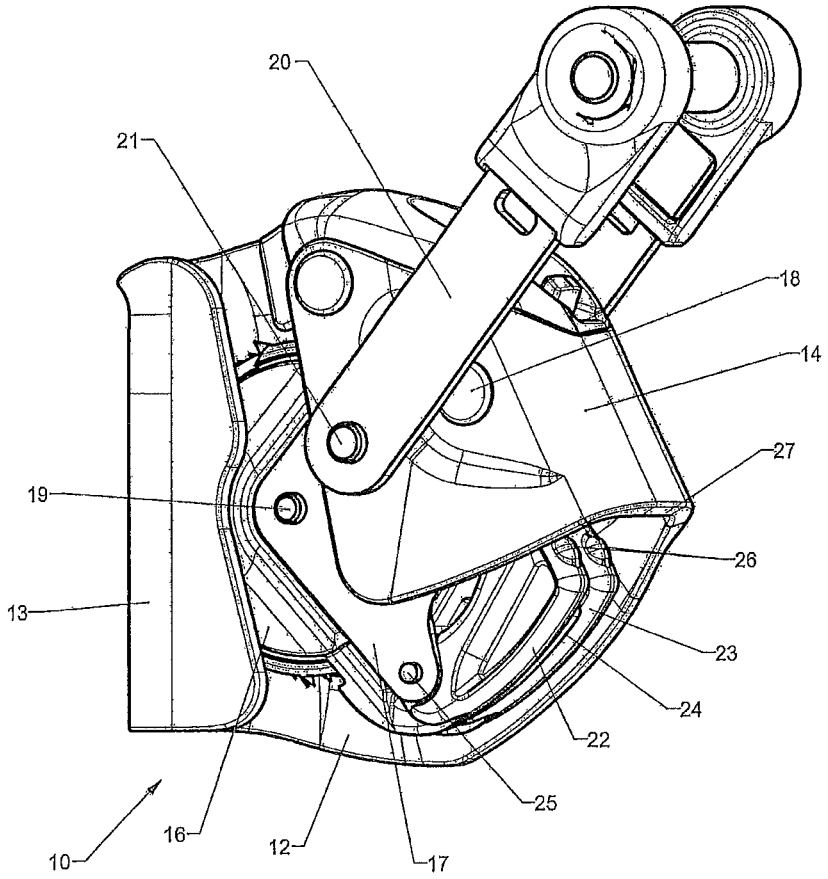
FIG. 1 is a perspective view of a fall arrest apparatus equipped with the secured securing system according to the invention, which is represented in the closed position without the rope being fitted.

With reference to FIGS. 1 to 4 and 4A, a fall arrest apparatus 10 is used for safety of a person moving along a fixed belaying rope 11. Fall arrest apparatus 10 is connected to the harness and follows the progression of the person without causing blocking in normal use for ascending or descending. The person is then free to move without any manual releasing action of fall arrest apparatus 10.

Fall arrest apparatus 10 comprises a rigid, preferably metallic, body 12 having on one side a straight trunking 13 of U-shaped cross-section for passage of rope 11, and on the other side a clamp 14 for fitting a securing system 15 with a blocking roller 16.

Securing system 15 with blocking roller 16 is able to occupy either an active blocking position in case of a fall or a released inactive position allowing progression of the person along rope 11 in the ascending direction or in the opposite direction during controlled descending. Roller 16 in the form of a cylindrical wheel is supported by a support device with a swivelling double arm 17 articulated around a first pivot-pin 18 of body 12. The peripheral surface of roller 16 is provided with inclined gripping spikes, and a torsion spring (not shown) is threaded onto first pivot-pin 18 to bias the assembly formed by support arm 17 and roller 16 in the direction of the bottom of trunking 13. Roller 16 is mounted rotating freely on a second pivot-pin 19 of arm 17, and the inside of roller 16 contains a centrifugal coupling (not shown) designed to occupy a disengaged position or an engaged position according to the speed or the acceleration of blocking roller 16. In normal use for ascending or descending, the centrifugal coupling is in the disengaged position and roller 16 follows the progression of the person without any manual releasing action of the securing system. In case of a fall, blocking takes place automatically when the coupling moves to the engaged position, resulting in a strong pressure of the roller against rope 11 which stops the fall. The principle and operation of such a securing system with centrifugal coupling are described for example in the documents EP 1525903 and EP 1380320.

The body further comprises a rocker arm 20 having a reverse U-shape mounted rocking around a third pivot-pin 21 outside body 12. Rocker arm 20 is designed to be connected to the user's harness either directly by a connecting lanyard or by means of a shock absorber.

To perform installation of rope 11 in trunking 13, securing system 15 with roller 16 simply has to be moved as far as possible from trunking 13 by making the assembly formed by arms 17 and roller 16 swivel in the counterclockwise direction against the bias force of the torsion spring.

Figure 2:
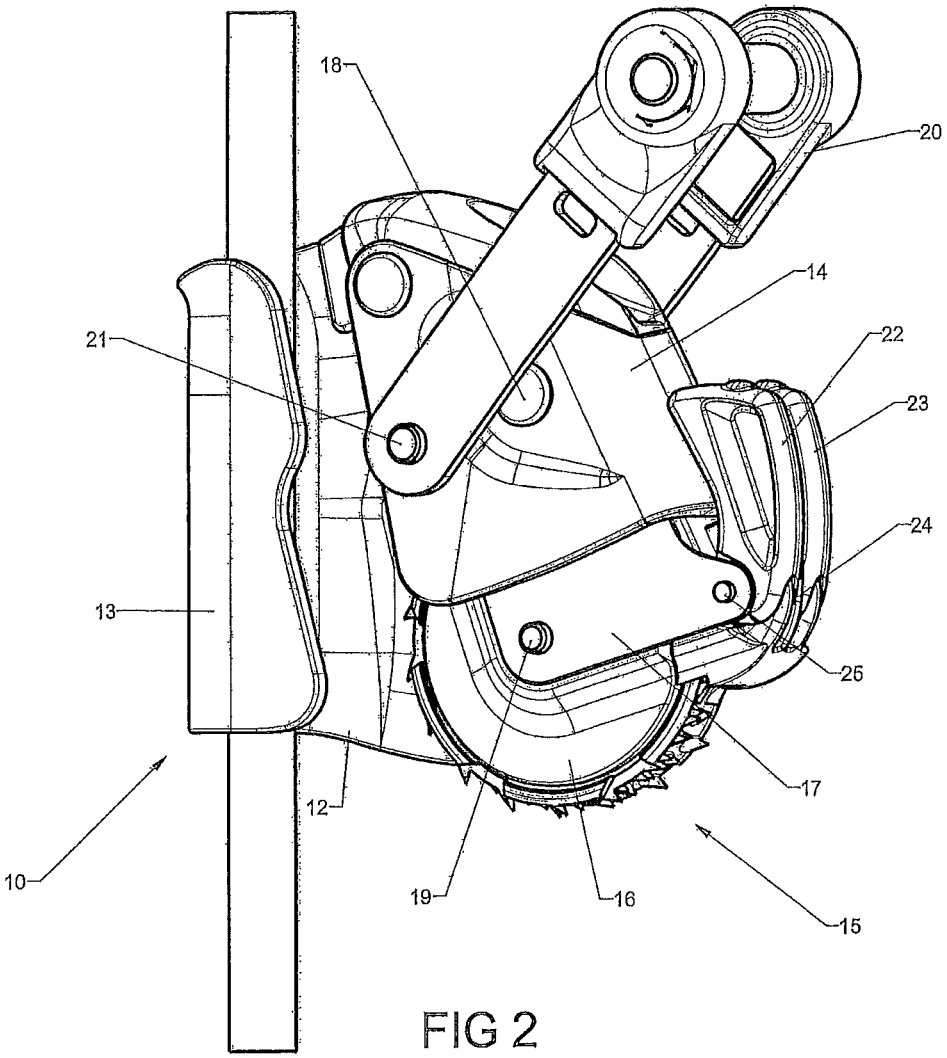
FIG. 2 shows an identical view to FIG. 1, in the stable open position of the securing system with the two cleats attached to the clamp of the body.
Figure 3:
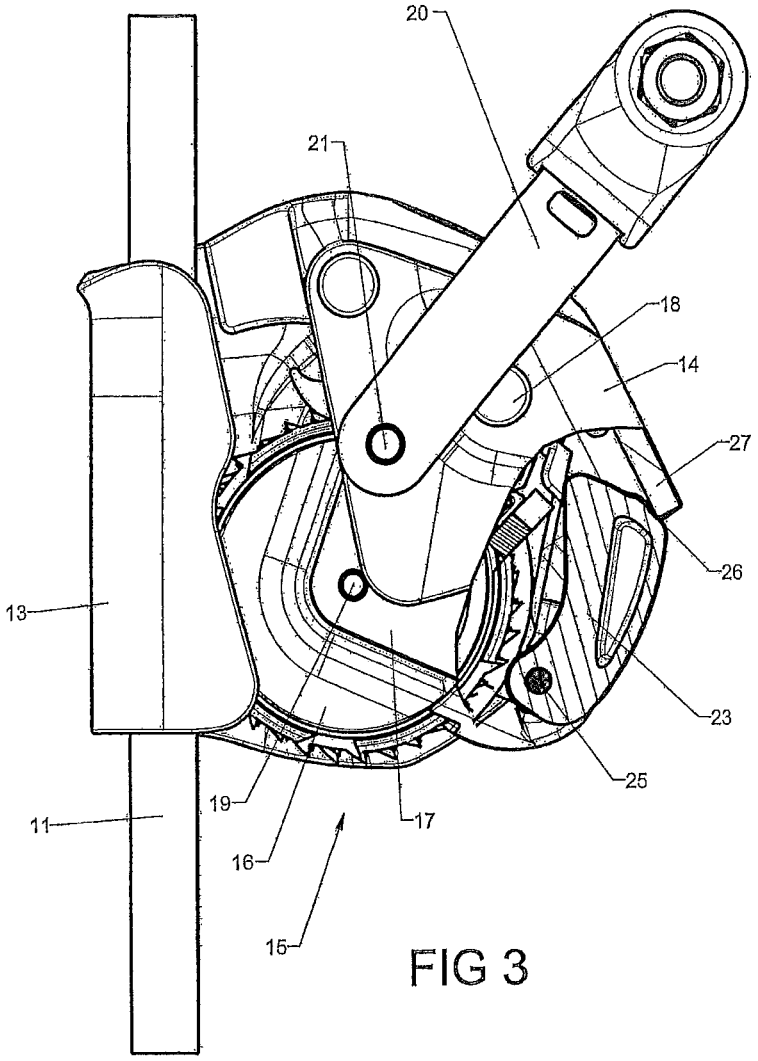
FIG. 3 is an elevational view partially in cross-section of FIG. 1 after the rope has been fitted.

Securing system 15 is equipped for this purpose with a pair of gripping cleats 22, 23 which are formed by levers of substantially identical structures, and which are arranged side by side with interposition of a fixed blade 24 made from plastic material. The two cleats 22, 23 are independent from one another and are articulated around a transverse pivot-pin 25 common to the two arms 17. Each cleat 22, 23 is associated with a bias spring designed to bias the latter to the work position (FIGS. 1 to 3).

Each cleat 22, 23 is equipped with a boss 26 situated opposite pivot-pin 25 and designed to come up against a stop 27 of clamp 14 when the two cleats are not simultaneously opened to the separated position allowing access to trunking 13.

Interposed blade 24, of small thickness, has the function of preventing driving or gripping of one of cleats 22 in the opening direction from moving the other cleat 23 to the separated position.

Operation of fall arrest device 10 with double cleat 22, 23 according to FIGS. 1 to 4A is as follows:

In FIG. 1, the apparatus is in the rest state, and roller 16 of securing system 15 is engaged in trunking 13, making access for fitting of the rope impossible. The two cleats 22, 23 are located inside body 12.

To gain access to the inside of trunking 13, the two cleats 22, 23 have to be actuated simultaneously to make the assembly formed by arms 17 and roller 16 pivot in the counterclockwise direction to a separated position of FIG. 2. In this stable position, the two cleats 22, 23 remain mechanically latched to stop 27 of clamp 14, enabling rope 11 to be inserted in trunking 13.

In FIG. 3, after rope 11 has been inserted, both or one of the two cleats 22, 23 simply has to be pressed to release the latching and move the assembly formed by arms 17 and roller 16 in the clockwise direction 17 due to the action of the bias spring. The spikes of roller 16 come into contact with rope 11 without exerting a blocking effect. The apparatus is in the state of use on a rope.

Figure 4:
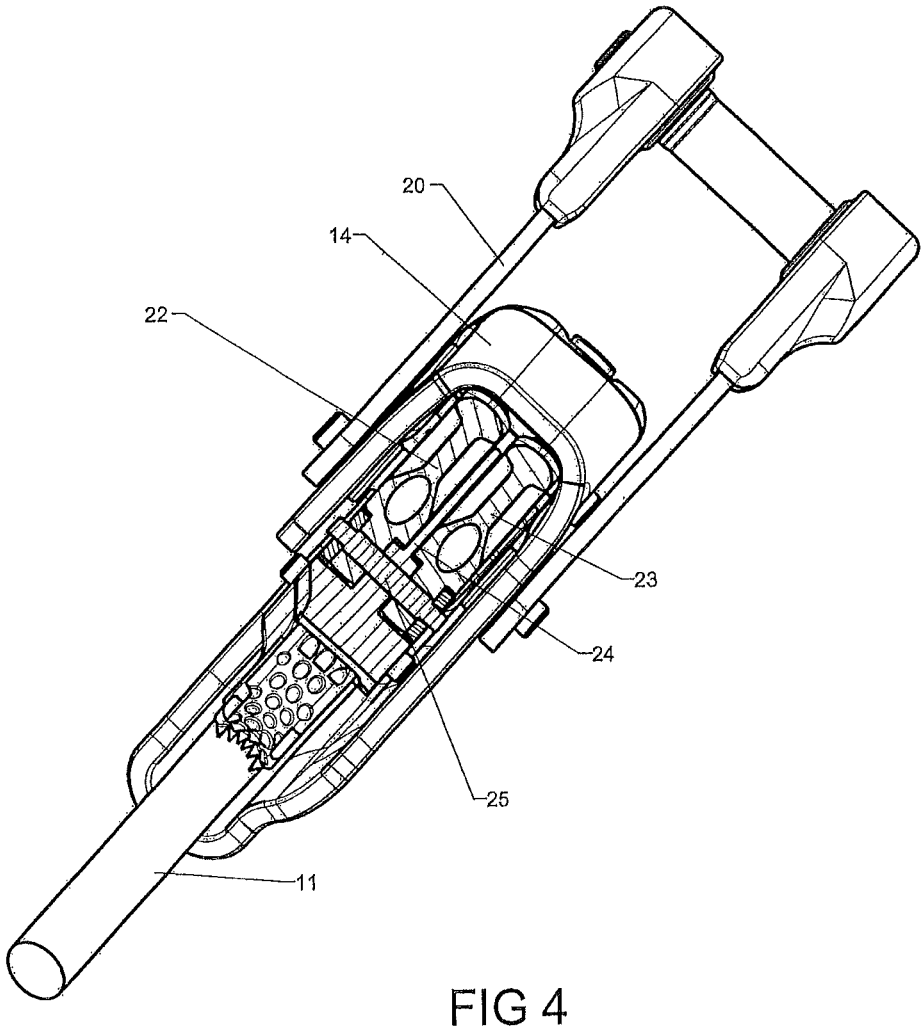
FIG. 4 represents a cross-sectional view of FIG. 3.
Figure 4A:
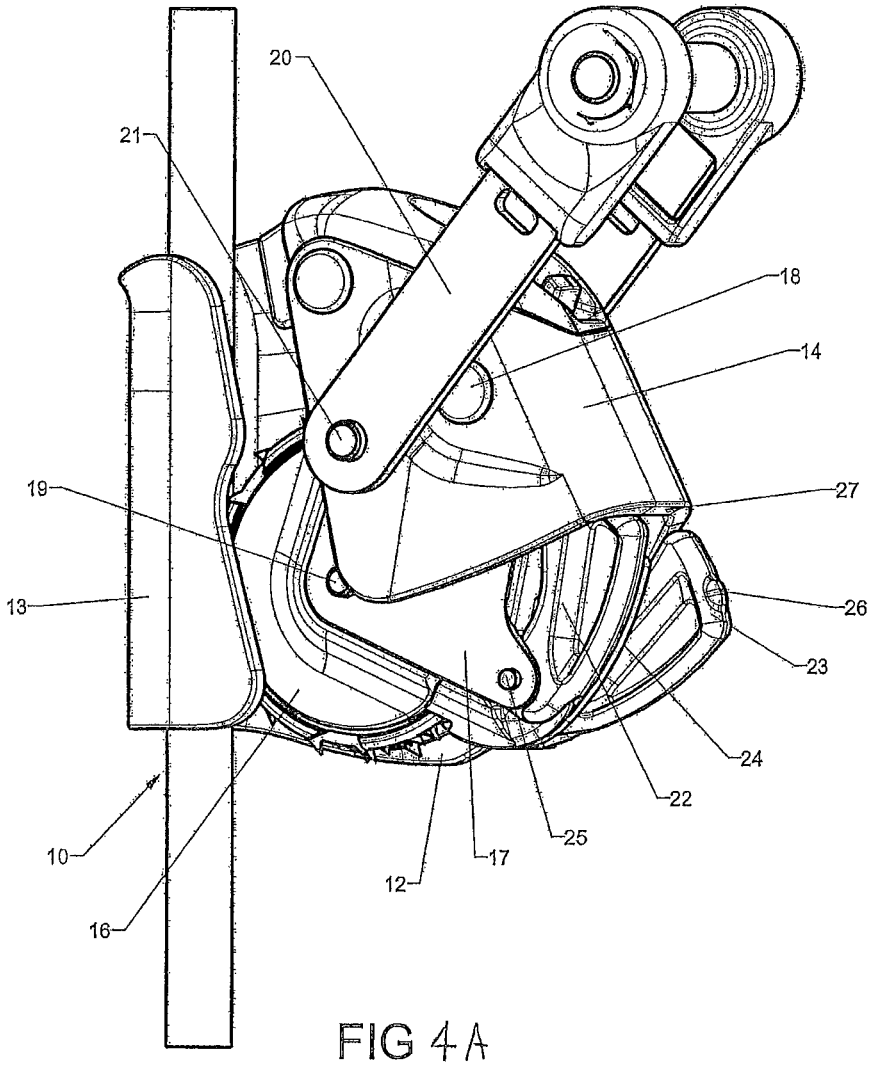
FIG. 4A represents a similar view to FIG. 2, with one cleat open and the other cleat closed.

In FIG. 4A, it can be observed that an involuntary or deliberate attempt to open one of cleats 22 moves boss 26 of the other cleat 23 until it comes up against stop 27. Access to trunking 13 is then rendered impossible, as the two cleats cannot be latched on stop 27 as in FIG. 2.

The presence of the two cleats 22, 23 enables operation of the apparatus to be secured by preventing involuntary opening and access to the rope.

Figure 5:
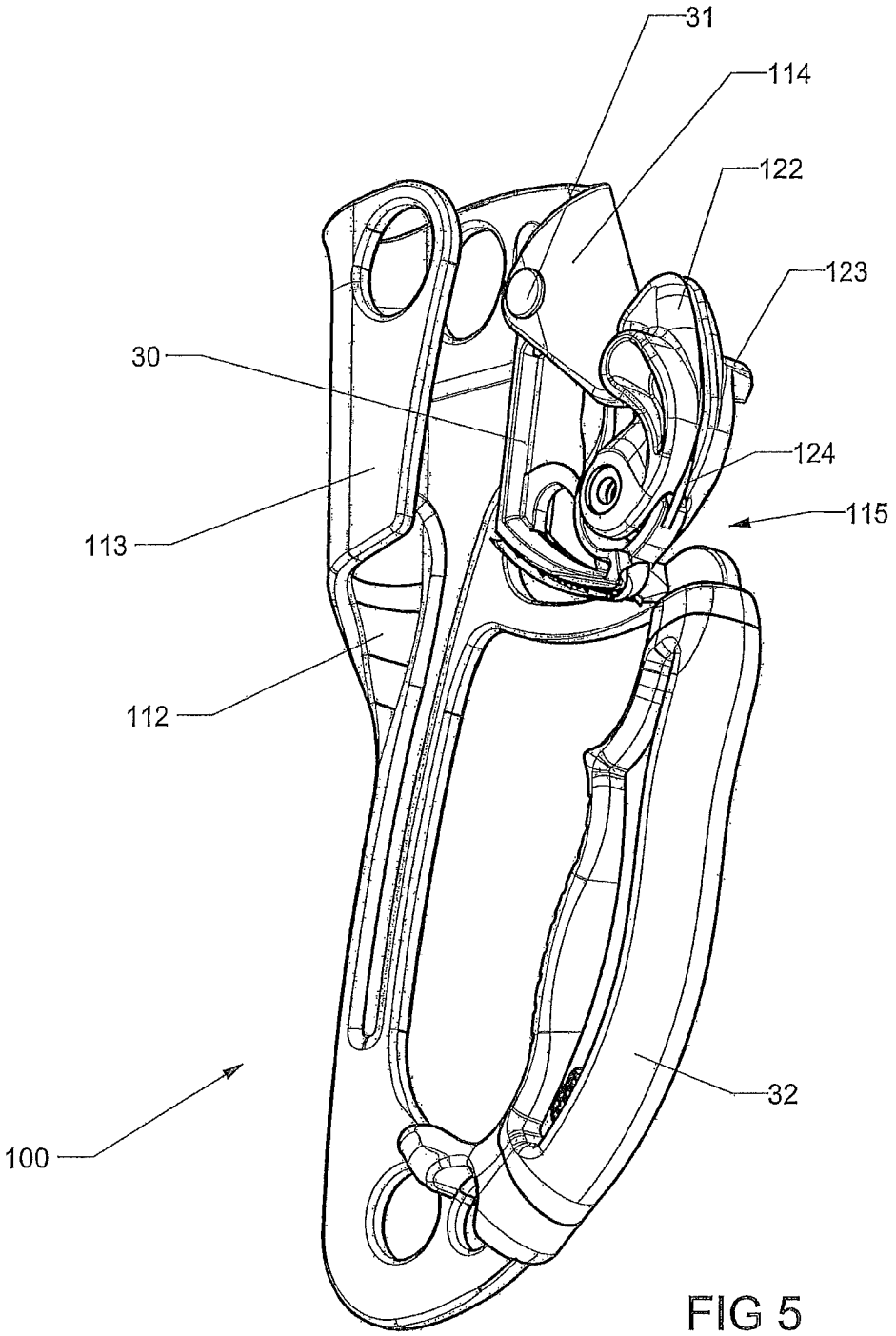
FIGS. 5 and 6 are perspective views of an alternative embodiment constituted by an ascender with a handle, which is equipped with the secured securing system according to the invention, respectively illustrated in the open position without a rope and the closed position with a rope.
Figure 7:
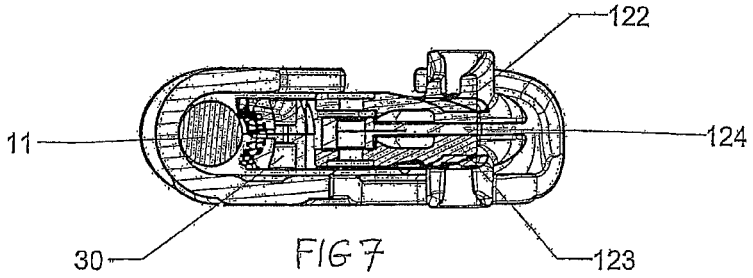
FIG. 7 is a cross-sectional view along the line B-B of the ascender of FIG. 6.
Figure 6:
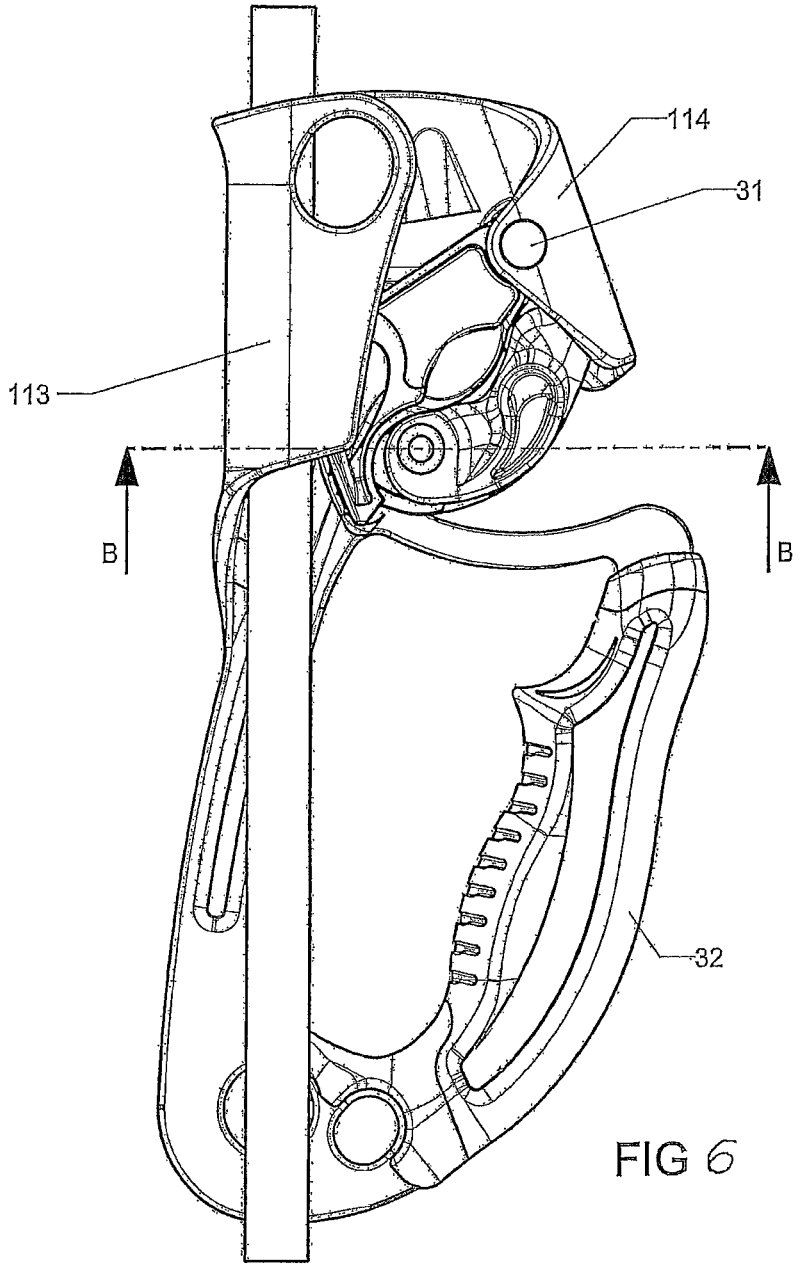

With reference to FIGS. 5 to 7, securing system 115 can be used for an ascender device 100. Such an apparatus comprises a body 112 with trunking 113, and a trigger 30 mounted swivelling around a pivot-pin 31 of a clamp 114.

A gripping handle 32 is fixed to body 112, and the surface coming into contact with the rope is provided with spikes. A bias spring biases trigger 30 towards the bottom of trunking 113.

The two cleats 122, 123 of the securing system are articulated on trigger 30 and are separated from one another by an interposed blade 124 made from plastic material.

Opening of trigger 30 is secured and requires simultaneous actuation of the two cleats 122, 123 to make trigger 30 pivot to the open position in which the cleats are latched on clamp 114.

The invention claimed is:

1. A fall arrest safety apparatus with blocking on a rope, comprising:

a rigid body provided with a trunking for housing the rope, a securing system designed to swivel between a closed position to collaborate with the rope by blocking the rope at the bottom of the trunking in case of a fall, and an open position releasing access to the trunking for fitting or removal of the rope, and a control device to move said securing system from the closed position to the open position, and vice-versa, wherein the control device comprises a pair of gripping cleats which are independently movable from each other and able to be actuated simultaneously to stabilize and lock the securing system in the open position allowing access to the trunking, the two gripping cleats being arranged side by side and articulated on a transverse pivot-pin integral to the pivoting securing system.

2. The safety apparatus according to claim 1, wherein a fixed blade made from plastic material is interposed between the two gripping cleats to prevent pressing of one of the cleats from causing movement of the other cleat.

3. The safety apparatus according to claim 1, wherein each gripping cleat is equipped with a boss designed to come up against a stop of the body when the two cleats are not actuated simultaneously in the opening direction, making locking in the open position and access to the trunking impossible.

4. The safety apparatus according to claim 1, wherein the securing system comprises a blocking roller supported by a support device with a double swivelling arm, the transverse pivot-pin of the two cleats being integral to the double arm.

5. The safety apparatus according to claim 1, wherein the safety apparatus is an ascender device and the securing system is equipped with a pivoting trigger, the two cleats being articulated on the trigger to be latched to the body in the open position.

6. The safety apparatus according to claim 1, wherein the transverse pivot-pin is a fixed transverse pivot-pin.

7. A fall arrest safety apparatus with blocking on a rope, comprising:

a rigid body provided with a trunking for housing the rope, a securing system designed to swivel between a closed position to collaborate with the rope by blocking the rope at the bottom of the trunking in case of a fall, and an open position releasing access to the trunking for fitting or removal of the rope, and a control device to move said securing system from the closed position to the open position, and vice-versa, wherein the control device comprises a pair of gripping cleats able to be actuated simultaneously to stabilize and lock the securing system in the open position allowing access to the trunking, the two gripping cleats being arranged side by side on a transverse pivot-pin integral to the pivoting securing system, and wherein a fixed blade made from plastic material is interposed between the two gripping cleats to prevent pressing of one of the cleats from causing movement of the other cleat.

8. The safety apparatus according to claim 7, wherein each gripping cleat is equipped with a boss designed to come up against a stop of the body when the two cleats are not actuated simultaneously in the opening direction, making locking in the open position and access to the trunking impossible.

9. The safety apparatus according to claim 7, wherein the securing system comprises a blocking roller supported by a support device with a double swivelling arm, the transverse pivot-pin of the two cleats being integral to the double arm.

10. The safety apparatus according to claim 7, wherein the safety apparatus is an ascender device and the securing system is equipped with a pivoting trigger, the two cleats being articulated on the trigger to be latched to the body in the open position.

* * * * *